US010037834B2

(12) United States Patent
Buck et al.

(10) Patent No.: US 10,037,834 B2
(45) Date of Patent: Jul. 31, 2018

(54) CABLE HAVING A SPARSE SHIELD

(71) Applicant: Tyco Electronics Corporation, Berwyn, PA (US)

(72) Inventors: Arthur G. Buck, Sherwood, OR (US); Yevgeniy Mayevskiy, Lake Oswego, OR (US); Malai H. Khamphilavong, Woodburn, OR (US); Thuong A. Huynh, Beaverton, OR (US); Paul C. Sprunger, Dundee, OR (US)

(73) Assignee: CREGANNA UNLIMITED COMPANY, Galway (IE)

( * ) Notice: Subject to any disclaimer, the term of this patent is extended or adjusted under 35 U.S.C. 154(b) by 0 days.

(21) Appl. No.: 14/764,533

(22) PCT Filed: Jan. 29, 2014

(86) PCT No.: PCT/US2014/013673

§ 371 (c)(1),
(2) Date: Jul. 29, 2015

(87) PCT Pub. No.: WO2014/120826

PCT Pub. Date: Aug. 7, 2014

(65) Prior Publication Data

US 2015/0371738 A1 Dec. 24, 2015

Related U.S. Application Data

(63) Continuation-in-part of application No. 13/753,358, filed on Jan. 29, 2013, now abandoned.

(51) Int. Cl.
*H01B 1/02* (2006.01)
*H01B 7/00* (2006.01)
(Continued)

(52) U.S. Cl.
CPC ..... *H01B 11/1895* (2013.01); *H01B 1/02* (2013.01); *H01B 7/00* (2013.01); *H01B 7/0216* (2013.01);
(Continued)

(58) Field of Classification Search
CPC ..... H01B 11/1895; H01B 1/02; H01B 7/00; H01B 7/0216; H01B 7/041; H01B 7/1813;
(Continued)

(56) References Cited

U.S. PATENT DOCUMENTS 2,933,457 A 4/1960 Steinberg
3,126,358 A 3/1964 Lemmerich
(Continued)

FOREIGN PATENT DOCUMENTS

CN 1352799 A 6/2002
CN 1695208 A 11/2005
(Continued)

OTHER PUBLICATIONS

International Search Report for International Application No. PCT/US2014/013673, dated Mar. 14, 2014.
(Continued)

*Primary Examiner* — Timothy Thompson
*Assistant Examiner* — Michael F McAllister

(57) ABSTRACT

A cable (210) includes a center conductor (220). An insulating material in the form of a layer (225) surrounds the center conductor. A sparse shield (232) partially surrounds the insulating material. The sparse shield may include a plurality of conductors, which are grouped adjacent to one another within a space around the insulating layer that has a length that is less than 25% of the total circumference of the
(Continued)

insulating layer. An insulating jacket (227) covers the sparse shield and the remainder of the cable. The cable may be used in a cable assembly (10).

13 Claims, 5 Drawing Sheets

(51) Int. Cl.

| | |
|---|---|
| ***H01B 13/22*** | (2006.01) |
| ***H01B 11/18*** | (2006.01) |
| ***H01B 7/04*** | (2006.01) |
| ***H01B 7/08*** | (2006.01) |
| ***H01B 11/20*** | (2006.01) |
| ***H01B 7/02*** | (2006.01) |
| ***H01B 13/016*** | (2006.01) |

(52) U.S. Cl.
CPC ..... *H01B 7/041* (2013.01); *H01B 7/0892* (2013.01); *H01B 11/1813* (2013.01); *H01B 11/1821* (2013.01); *H01B 11/203* (2013.01); *H01B 13/0165* (2013.01); *H01B 13/22* (2013.01); *Y10T 29/49124* (2015.01)

(58) Field of Classification Search
CPC ..... H01B 11/1821; H01B 11/203; H01B 13/0165
USPC ..... 174/103
See application file for complete search history.

(56) References Cited

U.S. PATENT DOCUMENTS

| | | | | | |
|---|---|---|---|---|---|
| 3,512,946 | A | | 5/1970 | Hutkin | |
| 3,639,674 | A | | 2/1972 | Stier | |
| 3,644,662 | A | | 2/1972 | Salahshourian | |
| 3,870,977 | A | * | 3/1975 | Peoples | H01P 3/02 333/237 |
| 3,927,247 | A | * | 12/1975 | Timmons | H01B 11/1808 174/107 |
| 4,374,299 | A | | 2/1983 | Kincaid | |
| 4,424,403 | A | | 1/1984 | Bogese, II | |
| 4,599,121 | A | | 7/1986 | Edwards et al. | |
| 4,606,074 | A | * | 8/1986 | Rodeffer | H03J 9/002 455/131 |
| 4,691,081 | A | | 9/1987 | Gupta | |
| 4,965,412 | A | * | 10/1990 | Lai | H01B 11/1808 174/106 R |
| 4,986,372 | A | * | 1/1991 | Ganssle | H01B 9/025 156/51 |
| 5,523,534 | A | * | 6/1996 | Meister | H01B 7/0009 174/102 SC |
| 5,665,940 | A | | 9/1997 | Chimura et al. | |
| 5,827,997 | A | | 10/1998 | Chung et al. | |
| 6,472,603 | B1 | | 10/2002 | Inoue | |
| 6,580,034 | B2 | * | 6/2003 | Daane | H01B 7/0892 174/113 R |
| 6,651,318 | B2 | * | 11/2003 | Buck | H01B 7/0892 156/56 |
| 6,734,362 | B2 | * | 5/2004 | Buck | H01B 7/041 174/113 R |
| 7,271,340 | B2 | * | 9/2007 | Buck | H01B 7/0892 174/113 R |
| 7,471,258 | B2 | | 12/2008 | Hsu et al. | |
| 7,491,883 | B2 | | 2/2009 | Lee et al. | |
| 8,013,252 | B2 | * | 9/2011 | Daane | H01B 7/0892 174/113 R |
| 2002/0139561 | A1 | * | 10/2002 | Buck | H01B 7/0892 174/113 R |
| 2004/0194996 | A1 | * | 10/2004 | Ysbrand | H01B 11/146 174/102 SC |
| 2004/0200634 | A1 | | 10/2004 | Ysbrand | |
| 2005/0011664 | A1 | | 1/2005 | Lee | |
| 2005/0106522 | A1 | | 5/2005 | Eroglu et al. | |
| 2010/0000754 | A1 | | 1/2010 | Mann et al. | |
| 2010/0096597 | A1 | | 4/2010 | Prud'Homme et al. | |
| 2010/0144904 | A1 | | 6/2010 | Wang et al. | |
| 2011/0079410 | A1 | * | 4/2011 | Eshima | H01B 11/1821 174/24 |
| 2011/0232937 | A1 | | 9/2011 | Montena et al. | |
| 2012/0043107 | A1 | | 2/2012 | Nair | |
| 2013/0025907 | A1 | | 1/2013 | Zheng et al. | |
| 2013/0048337 | A1 | | 2/2013 | Hemond et al. | |
| 2013/0068521 | A1 | | 3/2013 | Hong et al. | |
| 2013/0217249 | A1 | | 8/2013 | Patel et al. | |
| 2014/0014392 | A1 | | 1/2014 | Armbrecht et al. | |

FOREIGN PATENT DOCUMENTS

| | | | |
|---|---|---|---|
| CN | 1889196 | A | 1/2007 |
| CN | 2881897 | Y | 3/2007 |
| CN | 201233756 | Y | 5/2009 |
| CN | 102034567 | A | 4/2011 |
| CN | 102782776 | A | 11/2012 |
| CN | 202694973 | U | 1/2013 |
| DE | 202011005272 | U1 | 2/2012 |
| GB | 1106010 | A | 3/1968 |
| WO | WO-94/02948 | A1 | 2/1994 |

OTHER PUBLICATIONS

International Search Report for International Application No. PCT/US2014/013672, dated Mar. 14, 2014.
Search Report from First Office Action for Chinese Patent Application No. 201480006337.1, dated Mar. 21, 2016.

* cited by examiner

CABLE HAVING A SPARSE SHIELD

CROSS-REFERENCE TO RELATED APPLICATIONS

This application is a continuation-in-part of co-pending, commonly assigned U.S. application Ser. No. 13/753,358, filed Jan. 29, 2103, and a continuation-in-part application of copending, commonly assigned International Application No. PCT/US2014/013673, filed Jan. 29, 2014, the disclosure of each of which is incorporated herein by reference.

BACKGROUND OF THE INVENTION

Field of the Invention

This application relates to a cable. In particular, this application relates to a cable with an insulated wire that is covered by a conductive coating, partially covered by a sparse shield, and covered by an insulating jacket.

Introduction to the Invention

Many medical devices include a base unit and a remote unit where the remote unit communicates information to and from the base unit. The base unit then processes information communicated from the remote unit and provides diagnostic information, reports, and the like. In some arrangements, a cable that includes a group of electrical wires couples the remote unit to the base unit. The size of the cable typically depends on the number of conductors running through the cable and the gauge or thickness of the conductors. The number of conductors running within the cable tends to be selected according to the amount of information communicated from the remote unit to the base unit. That is, the higher the amount of information, the greater the number of conductors.

In more advanced medical devices that use the base/remote unit arrangement, a great deal of information may be communicated between the remote component and the base unit. For example, a transducer of an ultrasound machine may communicate analog information over hundreds of conductors to an ultrasound image processor. Electrical cross-talk between adjacent conductors can become an issue. One way to reduce cross-talk is to increase the thickness of the insulating material that surrounds respective conductors. In some cases, a braided shield wire may be wrapped entirely around the insulating material to further improve the cross-talk characteristics. However, increased thickness of the insulating material and the addition of a braided shield wire result in a decrease in the number of conductors that may pass through a cable of a given diameter. To alleviate this problem, higher gauge conductors (i.e., thinner conductors) may be utilized. However, the thinner conductors tend to be more fragile, thus limiting the useful life of the cable. In addition, the cable attenuation is increased when the higher gauge conductors are used.

BRIEF SUMMARY OF THE INVENTION

In a first aspect, a shielded cable is provided. The cable includes a center conductor. An insulating material in the form of a layer surrounds the center conductor. A conductive coating can be formed on an outside surface of the insulating material. A sparse shield partially surrounds the insulating layer. An insulator covers the sparse shield.

In a second aspect, a cable includes a center conductor. An insulating layer surrounds the center conductor. A conductive coating is formed on an outside surface of the insulating layer and a sparse shield partially surrounds the conductive coating. The sparse shield includes a plurality of conductors, which are grouped adjacent to one another within a space around the insulating layer that has a length that is less than 25% of the total circumference of the insulating layer. An insulator covers the sparse shield.

In another aspect of the application, a shielded cable assembly that includes a plurality of cables is provided. Each cable has a first end, an intermediate section, and a second end. The intermediate sections of the respective cables are detached from one another. A conductive shield surrounds the respective intermediate sections of the cables. Each cable includes a center conductor, an insulating layer that surrounds the center conductor, and a sparse shield that partially surrounds the conductive coating that is on the outside surface of the insulating material. An insulator covers the sparse shield. In a preferred embodiment, the sparse shield includes a plurality of conductors. The conductors are grouped adjacent to one another such that each conductor is separated from an adjacent conductor by a distance that results in the cable of characteristic impedance that matches a load.

In yet another aspect of the application, a method for manufacturing a shielded cable is provided. The method includes providing a center conductor, forming an insulating layer around the center conductor, and partially surrounding the conductive coating with a sparse shield. The method also includes providing an insulator that covers the sparse shield and may include determining a desired characteristic impedance of the cable and having a plurality of conductors that are separated from one another by a distance corresponding to a distance that results in the cable having the desired characteristic impedance.

Other aspects, features, and advantages will be, or will become, apparent to one with skill in the art upon examination of the following figures and detailed description. It is intended that all such additional features and advantages included within this description be within the scope of the claims, and be protected by the following claims.

BRIEF DESCRIPTION OF THE DRAWINGS

The accompanying drawings are included to provide a further understanding of the claims, are incorporated in, and constitute a part of this specification. The detailed description and illustrated embodiments described serve to explain the principles defined by the claims.

DETAILED DESCRIPTION OF THE INVENTION

The embodiments described below overcome the problems with existing base/remote unit systems by providing a cable that includes insulated wires that have a conductive coating formed on an outside surface of the insulation and/or a sparse shield that partially covers the conductive coating on the outside layer of the insulation. The conductive coating, the sparse shield, or the combination of the conductive coating and the sparse shield generally decreases the mutual capacitance and inductance between adjacent wires and lessens the effects of electromagnetic interference on signals propagated over the wires. The conductive coating and/or sparse shield facilitates the use of an insulator with a smaller diameter than known wires, and thus facilitates an increase in the number of wires that may be positioned with a cable assembly of a given diameter.

Figure 1:
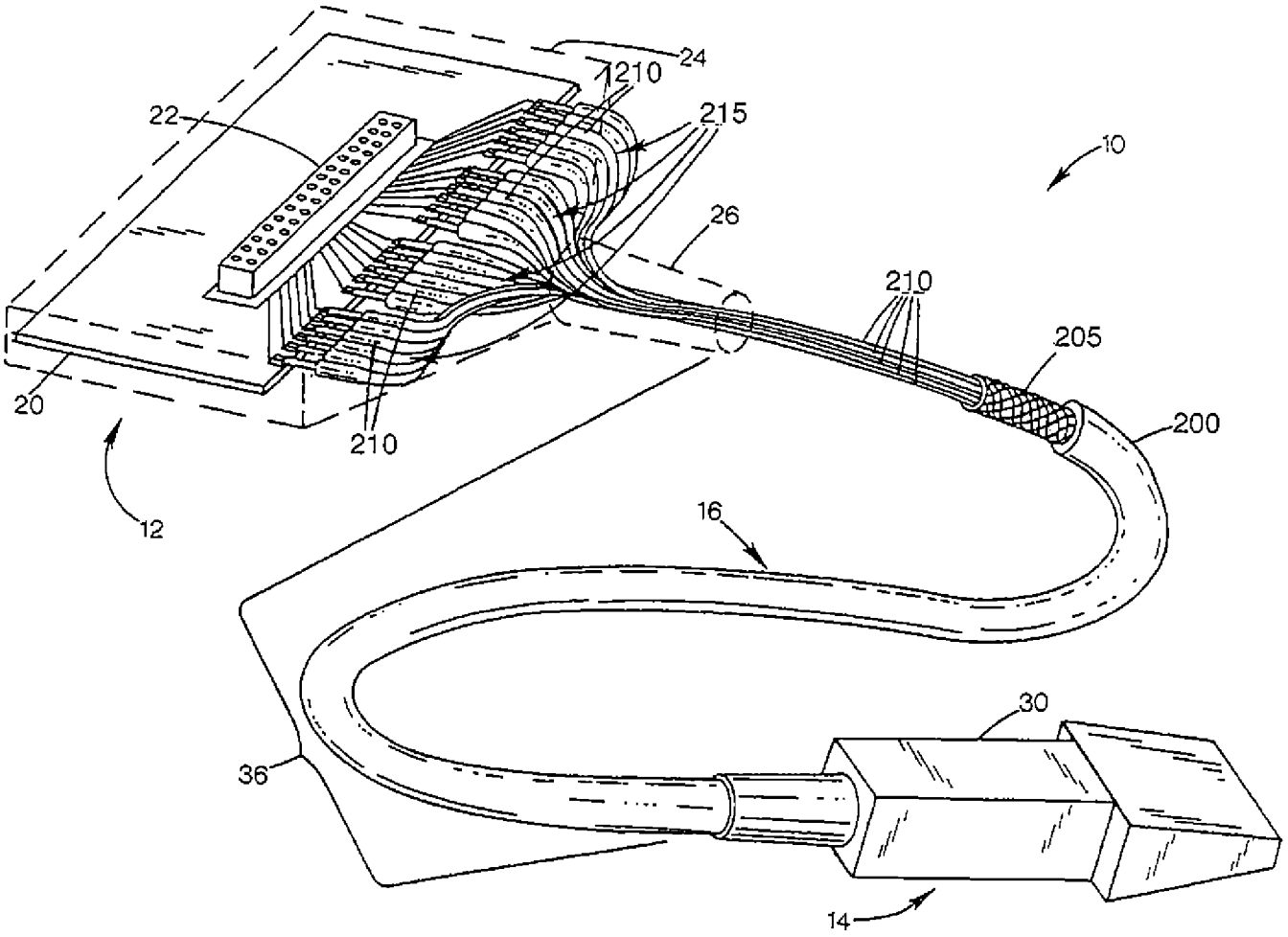
FIG. 1 is a perspective view of a cable assembly according to an embodiment.

FIG. 1 illustrates an exemplary cable assembly 10. The cable assembly 10 includes a connector end 12, a transducer end 14, and a connecting flexible cable assembly section 16. In the exemplary cable assembly 10, the connector end 12 includes a circuit board 20 with a header connector 22 configured to couple to an electronic instrument such as an ultrasound imaging machine (not shown). The connector end 12 includes a connector housing 24, and strain relief 26 that surrounds the end of the cable 16. An ultrasound transducer 30 may, for example, be connected to the transducer end 14. It is understood that the connector end 12 and transducer end 14 are merely exemplary. Moreover, the cable assembly 10 may be utilized to couple different components. The cable assembly could be applied to any application for which a cable assembly with the characteristics described herein is sufficient.

Figure 2A:
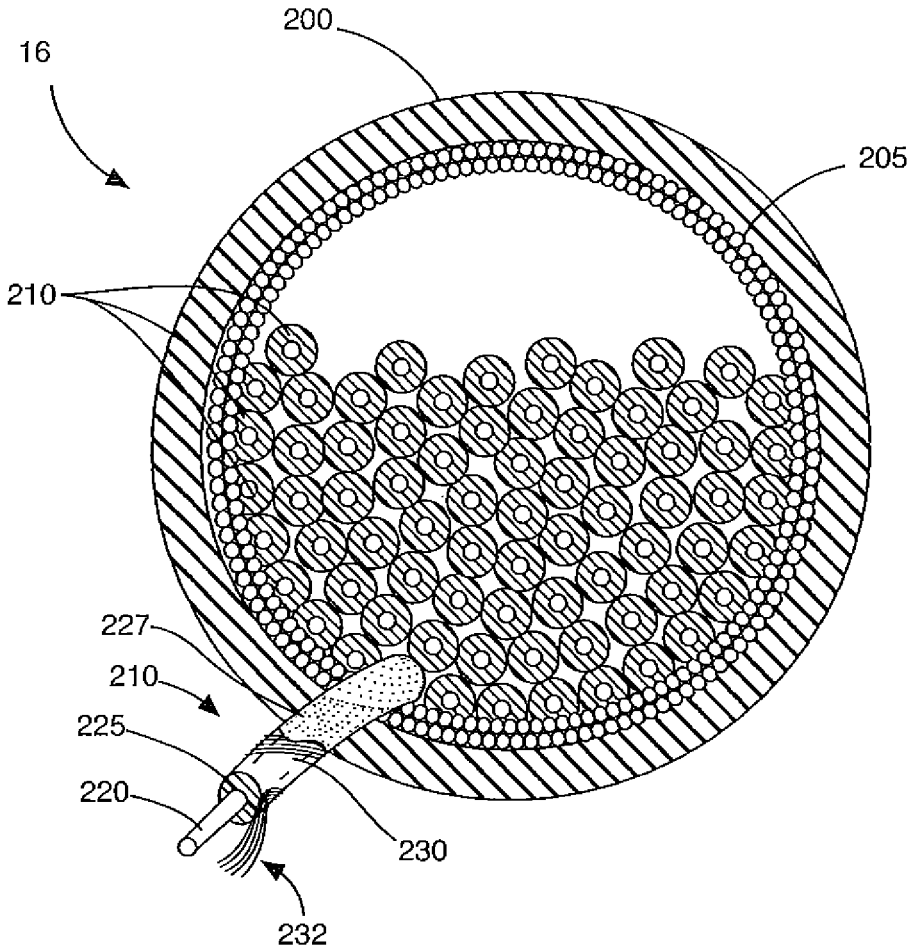
FIG. 2A is a cross-sectional view of an exemplary cable assembly section that may be utilized in the cable assembly of FIG. 1.

FIG. 2A illustrates an exemplary cross-section of the cable assembly section 16. The cable assembly section 16 includes a sheath 200, a braided shield 205, and a group of insulated cables 210. It should be understood that the number of insulated cables 210 is merely exemplary and not necessarily representative of any number of cables that may actually be required in any particular application.

The sheath 200 defines the exterior of the cable assembly section 16. The sheath 200 may be formed from any non-conductive flexible material, such as polyvinyl chloride (PVC), polyethylene, or polyurethane. The sheath 200 may have an exterior diameter of about 8.4 mm (0.33 inch). The bore diameter, which is measured at the inner diameter of the braided shield 205, if present, may be 6.9 mm (0.270 inch). This yields a bore cross-sectional area (when straight, in the circular shape) of 1.4 $mm^2$ (0.057 $inch^2$). This size sheath 200 facilitates the placement of about 64 to 256 cables 210. The diameter of the sheath 200 may be increased or decreased accordingly to accommodate a different number of insulated cables 210.

The braided shield 205 is provided on the interior surface of the sheath 200 and surrounds all the insulated cables 210. The braided shield 205 may be a conductive material, such as copper, or a different material suited for shielding cables from external sources of electromagnetic interference. In some implementations, the braided shield 205 may be silver-plated and may form a mesh-like structure that surrounds the insulated cables 210.

Figure 2B:
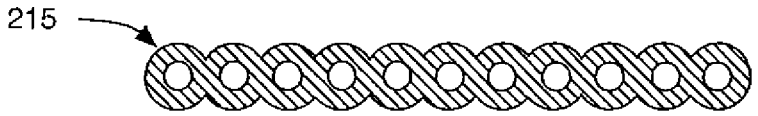
FIG. 2B is an exemplary ribbonized end section of the cable assembly section of FIG. 2A.

The insulated cables 210 may be arranged into sub-groups, with each sub-group having a "ribbonized" portion 215 (FIG. 2B) at each end of the cable assembly section 16. That is, insulated cables 210 of the sub-group may be attached or adhered to one another in a side-by-side manner to form a ribbon 215. Each ribbon portion 215 may be trimmed to expose a center conductor 220 of each of the insulated cables 210 of the ribbon portion 215 to facilitate connecting the insulated cables 210 to the circuit board 20, an electronic component, and/or connector, by any conventional means, as dictated by the needs of the application for which the cable assembly section 16 is used. The ribbon portions 215 may be marked with unique indicia to enable assemblers to correlate ribbon portions 215 at opposite ends of the cable assembly section 16.

In a middle section 36 (FIG. 1) of the cable assembly section 16, insulated cables 210 of the sub-group are generally loose and free to move independently of one another within the braided shield 205 and sheath 200. The separation of the cables improves flexibility of the cable assembly section 16 and lowers the level of cross-talk that occurs between adjacent insulated cables 210, as described in U.S. Pat. No. 6,734,362 B2, issued May 11, 2004, and U.S. patent application Ser. No. 13/753,339, filed contemporaneously with this application, which are incorporated herein by reference. The loose portions 36 of the insulated cables 210 extend the entire length of the cable assembly section 16 between the strain reliefs, through the strain reliefs, and into the housing where the ribbon portions 215 are laid out and connected.

Each insulated cable 210 includes a center conductor 220 that is surrounded by an insulating material 225 (i.e. a conductor insulating material in the form of a layer, also referred to herein as an insulating layer). A conductive coating 230 may be formed over the outside surface of the insulating material 225. In addition or as an alternative, some or all of the insulated cables 210 may be surrounded by a sparse shield 232 and then covered with an insulating jacket 227 (i.e. a sparse shield insulating layer, also referred to as an insulator or an insulating jacket). The insulating jacket 227 may be formed from any non-conductive flexible material such as a fluorocarbon, a polyester tape which may, for example, be helically wrapped, polyethylene, etc. The insulating jacket 227 may have a thickness of about 0.013 mm (0.0005 inches).

The center conductor 220 may be copper or a different conductive material. The center conductor 220 may be solid or stranded and may have a gauge of about 36 to 52 AWG, i.e. a diameter of about 0.13 mm (0.005 inch (solid wire) or 0.15 mm (0.006 inch (stranded wire) for 36 AWG and a diameter of 0.020 mm (0.00078 in (solid wire) for 52 AWG. The center conductor 220 material and gauge may be selected to facilitate a desired current flow though a given center conductor 220. For example, the gauge of the center conductor 220 may be decreased (i.e., increased in diameter) to facilitate increased current flow. Stranded as opposed to solid wire may be utilized to improve overall flexibility of the cable assembly section 16. The insulated cables 210 may all have the same characteristics or may be different. That is, the insulated cables 210 may have different gauges, different conductors, etc.

The insulating material 225 that surrounds the center conductor 220 may be made of a material such as a fluoropolymer, polyvinyl chloride (PVC), or polyethylene. The thickness of the insulating material 225 may be about 0.05 to 0.64 mm (0.002 to 0.025 inch) to meet electrical requirements. Increased thickness of the insulating material 225 improves the cross-talk characteristic (i.e. decreases the mutual capacitance between wires) and, therefore, lowers the cross-talk between adjacent insulated cables 210. On the other hand, the increase in thickness lowers the total number of insulated cables 210 that may be positioned within the braided shield 205. The thickness of the insulating material 225 may be used to control capacitance and characteristic impedance of the cable assembly section 16.

The conductive coating 230 may be any appropriate material such as carbon, graphite, graphene, silver, or copper, and may be in a suspended solution. For example, Dag 502 (also known as Electrodag 502), carbon/graphite particles in a fluoropolymer binder suspended in methylethylketone, may be used. It may be applied via a spraying or dispersion process or other process suited for applying a thin layer of conductive material. In one implementation, a product such as Vor-Ink™ Gravure from Vorbeck Materials, which contains graphene, may be applied via dispersion coating to a thickness about 0.005 mm (0.0002 inch). Application of the conductive coating 230 further lowers the mutual capacitance and inductance between adjacent insulated cables 210 and, therefore, further lowers the cross-talk. At the same time, the self-capacitance of the cable will increase; therefore, one way to control the characteristic impedance of the cables may be by varying the thickness and the conductivity of coating materials.

The sparse shield 232 is a conductive material, such as copper, that enhances the various characteristics described above. The sparse shield 232 is sparse in that it does not completely cover the insulating material 225, which is the case in typical shielded cables. In typical shielded cables, the shields are configured to provide as much coverage as possible. By contrast, the sparse shield 232 is configured to support desired crosstalk levels. Generally, the sparse shield 232 shields out the low frequency electromagnetic interference (EMI), while the conductive coating 230 shields out the high frequency EMI, thus compensating for the reduced coverage. For example, the sparse shield 232 may function as a shield up to a frequency of 50 MHz, while the conductive coating may function as a shield from 50 to 1000 MHz for a cable bundle length of about 1.8 m (6 ft). Utilization of a sparse shield 232 may result in a reduction in the diameter of the insulated cable 210, a reduction in the weight of the insulated cable, and/or a reduction in the cost associated with manufacturing the insulated cable 210.

The sparse shield 232 may be determined in one of several ways. In one embodiment, the sparse shield 232 is determined based on the resistance of the central conductor. For example, the degree to which the sparse shield 232 covers the insulating material may be adjusted depending on the desired characteristics of the insulated cable 210. In particular, insulated cables are typically shielded over the entire circumference of the insulated cable in order to minimize interference between cables. Nevertheless, adequate results may be achieved for a given application when the resistance of the sparse shield 232 is approximately the same or less than the resistance of the central conductor (such as matching the resistance of the center conductor). For example, for a center conductor 220 with resistance of 1.64 ohm/m (0.5 ohm/ft), the degree to which the sparse shield 232 covers the insulator may be adjusted so that the sparse shield has resistance of about 1.64 ohm/m (0.5 ohm/ft). Such a value is achievable by using a sparse shield that corresponds to a relatively small number of wire strands. By contrast, in typical coaxial cables, the shield resistance is about ten times smaller than the center conductor resistance.

In an alternate embodiment, the sparse shield 232 may be described based on an amount of the circumference of the center conductor that the sparse shield 232 covers. As merely some examples, the sparse shield 232 may cover less than 50%, less than 40%, less than 30%, less than 20%, less than 15%, less than 10%, or less than 5% of the circumference of the center conductor.

In one implementation, insulated cables 210 of about 1.8 m (6 ft) in length with the conductive coating 230 above and a sparse shield 232 that included five wires with a gauge of 48 AWG (a diameter of 0.031 mm (0.00124 in) (solid) and 0.038 mm (0.0015 in) (stranded)) and a turns-ratio of 0.024/mm (0.6/inch) were found to have the corresponding cross-talk between adjacent insulated cables 210 to be lower than about −40 dB between 1 MHz and 10 MHz compared to about −50 dB in traditional coaxial design. The addition of the conductive coating 230 and the sparse shield 232, therefore, facilitates a decrease in the thickness and weight of the cable 210 as compared to a standard coaxial cable of the same gauge and self capacitance, while providing sufficient crosstalk performance. Thus, the conductive coating 230 and sparse shield 232 facilitates an increase in the number of cables 210 that may be positioned within a sheath 200 of a given diameter when compared to traditional coaxial cable designs. It should be understood that the characteristics described above, as well as the characteristic impedance of the insulated cables 210, may be adjusted by selecting conductive coatings 230 that have different conductivities, changing the implementation of the sparse shield 232, changing the thickness of the insulating material 225 or selecting an insulating material 225 with a given dielectric constant, etc.

Figure 3A:
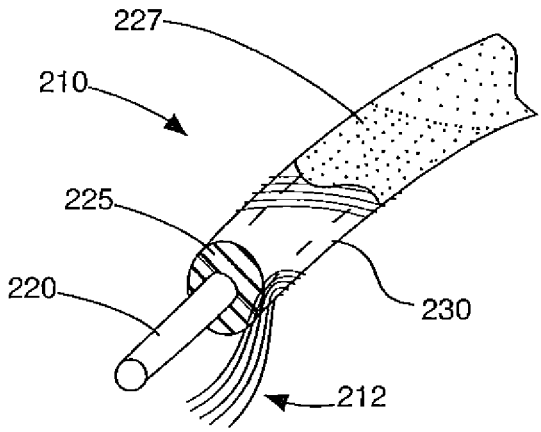
FIGS. 3A-3E illustrate exemplary implementations of a cable that may be included in the cable assembly section.
Figures 3B, 3C, 3D, 3E:
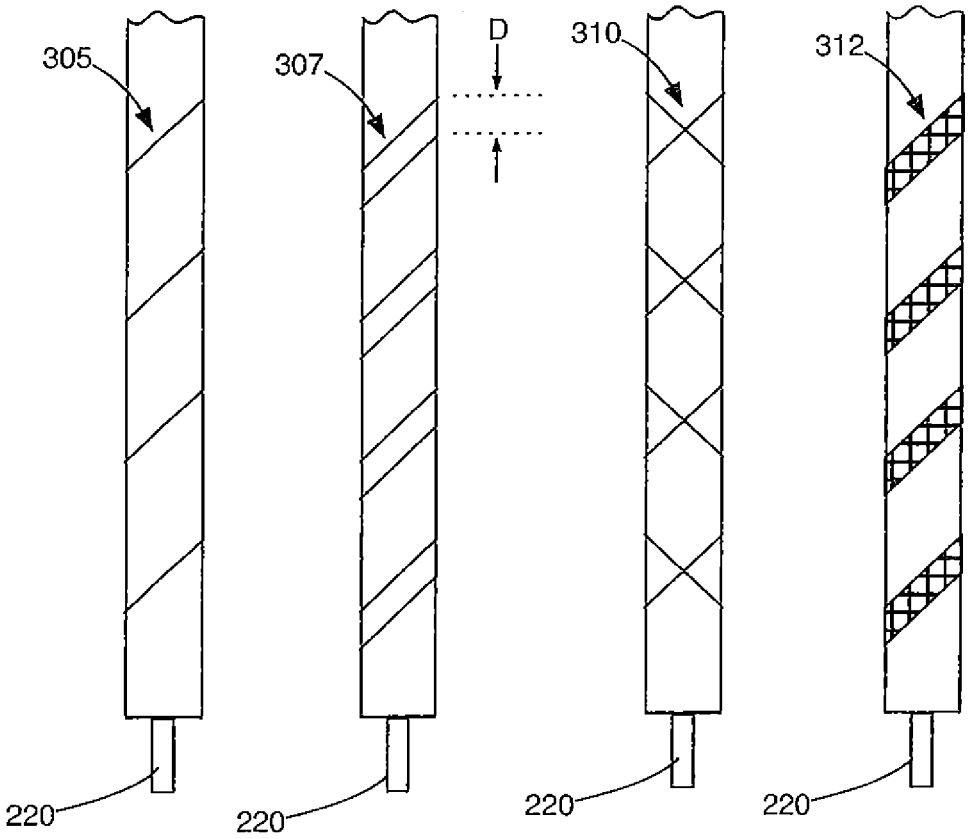

FIGS. 3A-3E illustrate various exemplary implementations for the sparse shield 232 that may be utilized to achieve the characteristic results above. For example, FIGS. 2A and 3A illustrate a sparse shield 232 that includes five conductors. In this case, when the gauge of the center conductor 220 is about 42 AWG, the gauge of each wire in the sparse shield 212 may be about 48 AWG so as to match the resistance of the center conductor. The five conductors collectively may cover less than about 20% of the outside surface of the insulating material 230. The number of conductors may be different. FIG. 3B, for example, illustrates a sparse shield 305 that includes a single strand of wire. Given the dimensions above for the insulated cable 210, the wire may have a gauge of about 42 AWG. FIG. 3C illustrates two wires, which may have half the cross sectional area per strand or an increase of 3 gauge numbers over the wire of FIG. 3B. This makes the resistance of the two wires to be approximately equal to the resistance of the center conductor.

One can appreciate that the number of wires and/or the gauge of the wires may be adjusted to obtain a desired resistance of the sparse shield or to change the characteristic impedance of the cable. In addition or alternatively, the number of turns per inch may be adjusted to obtain a desired resistance of the sparse shield. For example, a single wire with a gauge of 48 AWG and a turns-per-inch ratio of 0.6 (0.024 turns/mm) may have a resistance of about 29.5 ohm/m (9 ohm/ft). With these values, about 2 percent of the insulating material 230 is covered by the sparse shield 212. Two wires with a gauge of 48 AWG and a turns-per-inch ratio of 0.6 may have a resistance of about 14.8 ohm/m (4.5 ohm/ft). With these values, about 4 percent of the insulating material 230 is covered by the sparse shield 212. Three or more wires may be utilized as well. As the number of wires increases, the wire diameter required to achieve the characteristics above and/or the turns ratio of the wires may be adjusted accordingly. In addition, when multiple wires are utilized, the wires may be spaced apart and/or evenly distributed around the insulator. For example, adjacent wires may be separated by a variable distance, D, that results in the cable of a characteristic impedance that matches a load. For example, the distance may be about 0.15 mm (0.006 inch).

The manner in which the wires are wrapped is not limited to a single direction, as is the case in FIGS. 3B and 3C. For example, as illustrated in FIG. 3D, the wires 310 may cross each other. In addition, as illustrated in FIG. 3E, a braided wire ribbon 312 may be utilized for the sparse shield rather than single wires. Other combinations are possible.

Returning to FIG. 2, at respective ends of the cable assembly section 16, the sparse shield 212 may be terminated to ground. Grounding of the sparse shield 212 in turn grounds the conductive coating 230 of the insulated cables 210 by virtue of the contact between the sparse shield 212 and the conductive coatings 230 of respective insulated cables 210.

The grounding of the conductive coating 230 in turn reduces the effects of external sources of electromagnetic interference on the signals propagated via the insulated wires 210.

Figure 5:
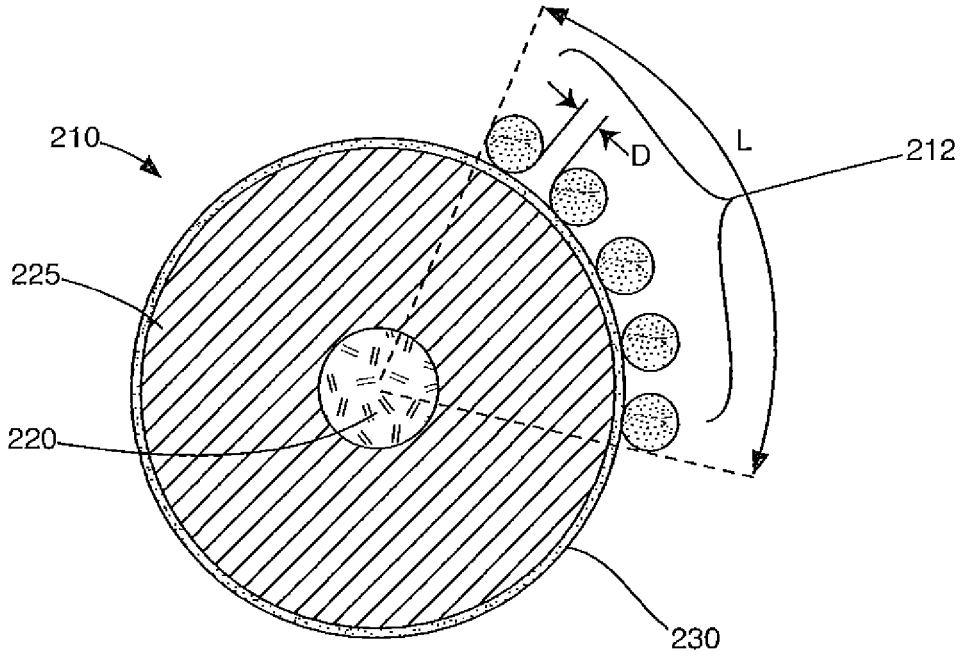
FIGS. 5 and 6 illustrate cross-sectional views of a cable that may be included in the cable assembly section.

Applicants have found, unexpectedly, that the characteristic impedance of the cables described above may be further controlled by adjusting the distance between adjacent wires of the sparse shield, and the amount of space around the dielectric occupied by the sparse shield. For example, referring to FIG. 5, the characteristic impedance of the cable 210 may be adjusted by adjusting a distance, D, between adjacent wires 212, and a length, L, around the circumference of the insulating layer 225 over which the wires occupy. Applicants have observed that in a typical coaxial cable, where the shield generally covers the entire outside surface area of the insulator, the H-field is confined within the dielectric. When the shield comprises a few evenly distributed wires, such as in the embodiments described above, an evenly distributed H-field begins to form outside of the insulator. In the embodiments describe above, the characteristic impedance of the cable is about the same as the characteristic impedance of the coaxial cable. However, when the same wires are grouped together towards one side of the insulator, the H-field becomes unevenly distributed with the highest intensity forming around the wires 212 of the sparse shield. The increased intensity of the H-field is due to the fringing effect, which effectively increases the inductance of the cable 210 and, therefore, increases the characteristic impedance of the cable 210. As the wires 212 are spread apart, the fringing decreases and the characteristic impedance of the cable 210 decreases. Thus, the characteristic impedance of the cable 212 can be further controlled by adjusting the spacing between wires, D, 212, such that the wires 212 are grouped adjacent to one another within a space around the insulating layer that has a length less than about xx % of the circumference of the insulating layer.

Figure 6:
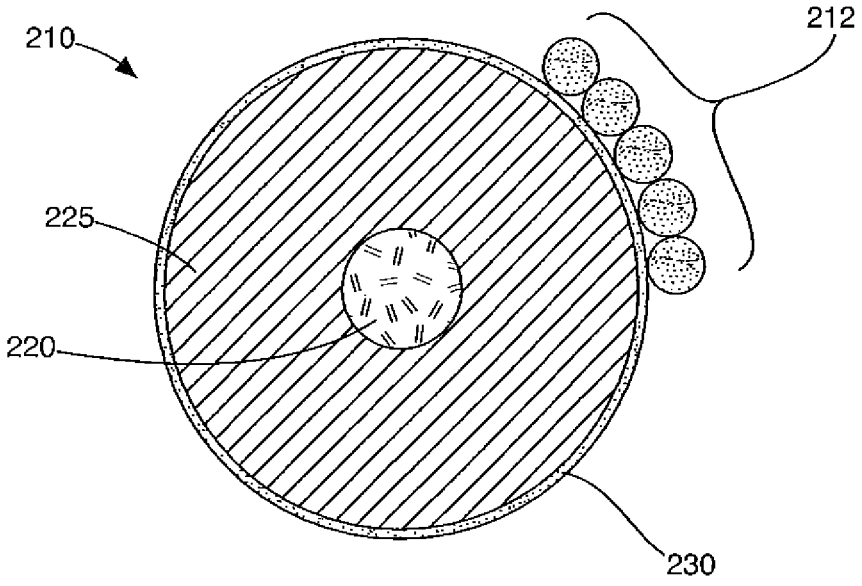

Table 1 compares the parameters of a typical coaxial cable, a coaxial cable with a 6-conductor evenly distributed sparse shield, and a coaxial cable with a 5-conductor sparse shield, where the conductors are grouped next to one another with substantially no space provided between adjacent conductors, as illustrated in FIG. 6.

TABLE 1

| | Typical Coaxial Cable | 6 conductor sparse shield (symmetrically spread) | 5 conductor, sparse shield (grouped conductors) |
|---|---|---|---|
| Center conductor(CC) | 42AWG Solid SPC | 42AWG Solid SPC Alloy | 42AWG Solid SPC Alloy |
| Dielectric | ePTFE/Heat-seal polyester tape | ePTFE/Heat-seal polyester tape | ePTFE/Heat-seal polyester tape |
| Shield | 46 AWG SPC (21 strands) | Graphene ink 48AWG SPC (6 strands) | Graphene ink 48AWG SPC (5 strands) |
| Jacket | Heat-seal polyester | Heat-seal polyester | Heat-seal polyester |
| Measured: | | | |
| CC DCR | 1.68 Ohms/ft | 1.68 Ohms/ft | 1.68 Ohms/ft |

TABLE 1-continued

| | Typical Coaxial Cable | 6 conductor sparse shield (symmetrically spread) | 5 conductor, sparse shield (grouped conductors) |
|---|---|---|---|
| Shield DCR | 0.21 Ohms/ft | 1.35 Ohms | 1.58 Ohms |
| Capacitance | 16 pF/ft | 18 pF/ft | 19 pF/ft |
| Characteristic impedance | 77 Ohms | 79 Ohms | 90 Ohms |

As shown in Table 1, the characteristic impedance of the typical coax cable and the 6-conductor sparse shield cable measure about the same at 77 Ohms and 79 Ohms, respectively. However, the 5-conductor sparse shield has a characteristic impedance of about 90 Ohms, which is more than 10 Ohms higher.

Figure 4:
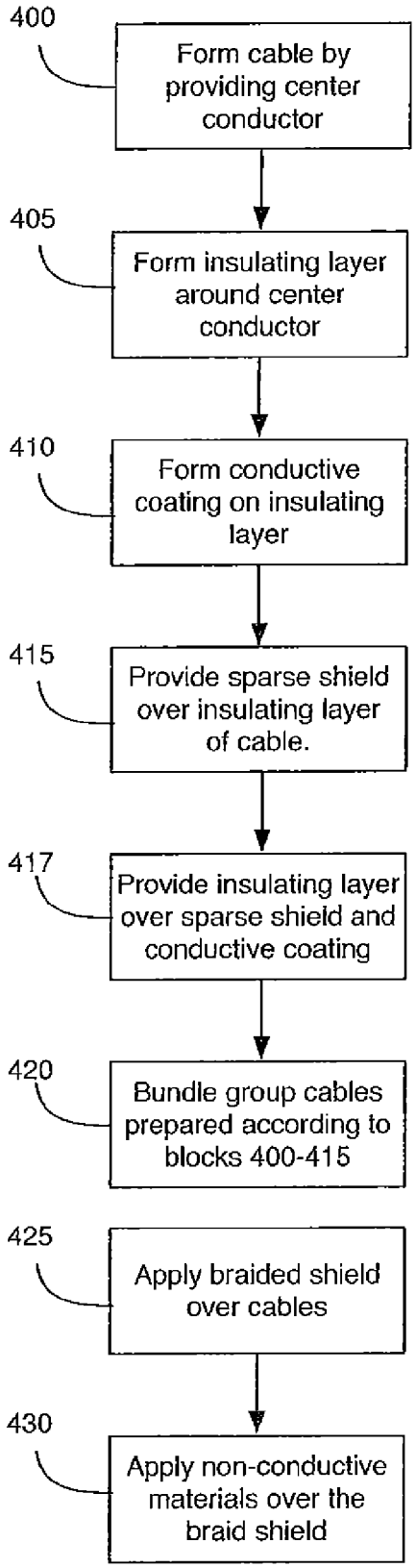
FIG. 4 illustrates a group of operations for forming the cables and the cable assembly of FIG. 2A.

FIG. 4 illustrates a group of operations for forming an insulated cable and cable assembly section that may correspond to the insulated cable 210 and cable assembly section 16, described above. At block 400, formation of an insulated cable begins by providing a center conductor. The center conductor may be copper or a different conductive material. The center conductor may have a solid core or may be stranded. A gauge of the center conductor may be 52 AWG to 36 AWG.

At block 405, an insulating material is formed as a layer around the center conductor. The insulating layer may be any suitable material, such as polyethylene or a fluorocarbon such as fluorinated ethylene propylene (FEP). The diameter of the insulating layer may be about 0.025 to 0.64 mm (0.001 to 0.025 inch).

At block 410, a conductive coating is formed on an outer surface of the insulating layer. The conductive coating may, for example, be applied via a spraying or dispersion process. The coating may be a material such as carbon, graphite, graphene, silver, or copper, and may be in a suspended solution. For example, Vor-Ink™ Gravure may be used. Other conductive materials capable of application on the insulating layer via spraying or dispersion may be utilized. The thickness of the conductive coating may be about 0.005 mm (0.0002 inch).

At block 415, a sparse shield is provided around the outer surface of the conductive coating. The sparse shield may include one, two or more wires, a braided wire, or a different configuration that results in a sparse shield with an impedance that matches an impedance of the center conductor.

At block 417, an insulating jacket may be formed over the sparse shield layer covering the sparse shield wire strands and any exposed conductive coating. The insulating jacket may be formed from a material, such as a fluorocarbon, a helically wrapped polyester tape, polyethylene, etc.

At block 420, a group of cables prepared in accordance with blocks 400-415 may be bundled together.

At block 425, a braided shield wire may be applied over the group of cables. The braided shield wire may be silver-plated copper and may be formed as a mesh configured to surround the cables.

At block 430, a sheath may be applied around the braided shield wire. The sheath may be a material such as polyvinyl chloride, a fluorocarbon polymer, or polyurethane, etc. The outside diameter of the sheath of about 0.635 to 12.7 mm (0.025 to 0.500 inch) may accommodate 10 to 500 wires within the sheath.

Other operations may be provided to further enhance the characteristics of the insulated cable and cable assembly section and/or to provide additional beneficial features. For example, in some implementations, first and/or second respective ends of the insulated cables are attached in a side-by-side manner to form one or more groups of ribbons. Insulated cables within the group may be selected based on a predetermined relationship between signals propagated over the wires.

While various embodiments of the embodiments have been described, it will be apparent to those of ordinary skill in the art that many more embodiments and implementations are possible that are within the scope of the claims. The various dimensions described above are merely exemplary and may be changed as necessary. Accordingly, it will be apparent to those of ordinary skill in the art that many more embodiments and implementations are possible that are within the scope of the claims. Therefore, the embodiments described are only provided to aid in understanding the claims and do not limit the scope of the claims.

What is claimed is:

1. A cable comprising a center conductor;

an insulating material that surrounds the center conductor in the form of a layer;

a sparse shield that partially surrounds the insulating material, the sparse shield being arranged around the insulating layer and comprising a plurality of conductors, the plurality of conductors being grouped adjacent to one another within a space around the insulating layer that has a length that is less than 25% of a total circumference of the insulating layer; and an insulator that covers the sparse shield, wherein the sparse shield has a DC resistance that substantially matches the DC resistance of the center conductor and wherein the sparse shield has a resistance of about 6.6 ohm/m (2 ohm/foot).

2. A cable comprising a center conductor;

an insulating material that surrounds the center conductor in the form of a layer;

a sparse shield that partially surrounds the insulating material, the sparse shield being arranged around the insulating layer and comprising a plurality of conductors, the plurality of conductors being grouped adjacent to one another within a space around the insulating layer that has a length that is less than 25% of a total circumference of the insulating layer; and an insulator that covers the sparse shield, wherein the sparse shield comprises five or fewer conductors with a gauge of greater than about 48 AWG.

3. The cable according to claim 2, wherein each conductor of the sparse shield is separated from an adjacent conductor of the sparse shield by a distance.

4. The cable according to claim 3, wherein the separation results in the cable having a characteristic impedance that matches a load.

5. The cable according to claim 2, wherein the sparse shield covers less than about 20 percent of a surface area of the outside surface of the insulating layer.

6. The cable according to claim 2, further comprising a conductive coating formed on an outside surface of the insulating layer, such that the conductive coating is between the outside surface of the insulating layer and the sparse shield.

7. The cable according to claim 2, wherein a thickness of the insulating layer surrounding the center conductor is about 0.025 to 0.64 mm (0.001 to 0.025 inch).

8. The cable according to claim 2, wherein the center conductor has a gauge between about 52 AWG to 36 AWG.

9. A cable assembly comprising a plurality of cables, each having a first end, an intermediate section, and a second end, wherein the intermediate sections of respective cables of the plurality of cables are detached from each other; and a conductive shield surrounding the respective intermediate sections of the plurality of wires:

wherein each cable of the plurality of wires includes:

a center conductor;

an insulating material that surrounds the center conductor in the form of a layer;

a sparse shield that partially surrounds the insulating layer, the sparse shield comprising a plurality of conductors, the plurality of conductors being grouped adjacent to one another, wherein each conductor is separated from an adjacent conductor by a distance that results in the cable of a characteristic impedance that matches a load; and an insulator to cover the sparse shield; and wherein the sparse shield comprises five or fewer conductors with a gauge of greater than about 42AWG.

10. The cable assembly according to claim 9, wherein the sparse shield has a resistance that substantially matches a resistance of the center conductor.

11. The cable assembly according to claim 9, wherein the plurality of conductors are grouped adjacent to one another within a space around the insulating layer that has a length that is less than 25% of a total circumference of the insulating layer.

12. The cable assembly according to claim 9, wherein each cable further comprises a conductive coating formed on an outside surface of the insulating layer, such that the conductive coating is between the outside surface of the insulating layer and the sparse shield.

13. The cable according to claim 6, wherein the conductive coating is a coating selected from the group of coatings consisting of: carbon, graphite, graphene, silver, copper, and said materials in a suspended solution.

* * * * *